US005976360A

United States Patent [19]

Blum et al.

[11] Patent Number: 5,976,360

[45] **Date of Patent: *Nov. 2, 1999**

[54] VISCOSITY REDUCTION BY HEAT SOAK-INDUCED NAPHTHENIC ACID DECOMPOSITION IN HYDROCARBON OILS

[75] Inventors: Saul Charles Blum, Edison; William Neergaard Olmstead, Murray Hill, both of N.J.

[73] Assignee: Exxon Research and Engineering Company, Florham Park, N.J.

[ * ] Notice: This patent is subject to a terminal disclaimer.

[21] Appl. No.: 08/999,869

[22] Filed: Oct. 10, 1997

Related U.S. Application Data

[63] Continuation of application No. 08/571,051, Dec. 12, 1995, abandoned, which is a continuation-in-part of application No. 08/546,201, Oct. 20, 1995, abandoned.

[51] Int. Cl.[6] ..... C10G 31/06

[52] U.S. Cl. ..... 208/263; 208/131; 208/132; 208/177

[58] Field of Search ..... 208/263, 131, 208/132, 177

[56] References Cited

U.S. PATENT DOCUMENTS

| | | | |
|---|---|---|---|
| 1,953,353 | 4/1934 | Lazar et al. | 208/263 |
| 2,186,425 | 1/1940 | Moser | 208/263 |
| 2,227,811 | 1/1941 | Moser | 208/263 |
| 5,820,750 | 10/1998 | Blum et al. | 208/263 |

*Primary Examiner*—Walter D. Griffin
*Attorney, Agent, or Firm*—Ronald D. Hantman

[57] ABSTRACT

The viscosity of hydrocarbon feeds in reduced from crudes or crude by thermal treatment.

9 Claims, No Drawings

VISCOSITY REDUCTION BY HEAT SOAK-INDUCED NAPHTHENIC ACID DECOMPOSITION IN HYDROCARBON OILS

This is a continuation of application Ser. No. 08/571,051, filed Dec. 12, 1995, now abandoned which is a continuation-in-part of application Ser. No. 08/546,201, filed Oct. 20, 1995, now abandoned.

BACKGROUND OF THE INVENTION

This invention relates to reducing the viscosity of hydrocarbon oils by heating.

Most crude oils with high total acid number by ASTM method D664 (TAN), usually 2 mg. KOH/g or more, are also very viscous. This increases the handling problem, for example at production wells because of the extra energy necessary to pipeline the crudes to load ports for shipping. Employing heat soaking near production sites lowers viscosity which reduces pipeline facilities costs and the pumping costs to load ports.

There is an economic incentive to lower the viscosity of heavy crude oils near the production site because it facilitates shipping by pipeline where that is the preferred initial transportation method. Lower viscosity crudes can be shipped by pipeline at lower cost because of lower investment from smaller diameter pipe, less or not heating of the crude, and/or less energetic pipeline pumps.

SUMMARY OF THE INVENTION

The present invention is a process for reducing the viscosity of crude oils or crude oil fractions having a high total acid number (TAN). The invention comprises thermally treating the feed in a treatment zone at a temperature of at least about 400° F. for a period of time sufficient to substantially reduce the viscosity. The thermal treatment substantially reduces the acid number of the crude oil. It is known that acids can increase the viscosity of crude oils by, e.g., hydrogen bonding (Fuel, 1994, 73, 257–268). By this treatment, the acids are decomposed and therefore can no longer participate in hydrogen bonding, thus decreasing the viscosity of the product from the treatment relative to the starting crude oil or crude oil fraction.

It is common in the refining of petroleum to heat the undistillable residue from vacuum distillation to temperatures sufficient to decrease the viscosity of the residue (see, e.g., Petroleum Refining: Technology and Economics, J. H. Gary and Glenn E. Handwerk, 3rd edition, Marcel Dekker, New York, 1994, pp. 89–94). This process (visbreaking) reduces the viscosity of the residue by breaking bonds and substantially reducing the molecular weights of the molecules. It also can substantially alter other properties of the product, such as its storage stability. In the present invention, the conditions of the treatment are milder, so that the storage stability of the product is not substantially affected. This can be accomplished for crude oils with high acid numbers because the decomposition of the acids occurs at milder conditions (lower temperatures and/or shorter times) than the breaking of bonds to substantially reduce the molecular weight. There may be some molecular weight reduction during the present invention, but it is the viscosity reduction by acid decomposition which is the primary goal.

DESCRIPTION OF THE PREFERRED EMBODIMENT

Feeds that may be effectively treated by this thermal treatment process include feeds containing naphthenic acids such as whole crudes or crude fractions. Crude fractions that may be treated are topped crudes (since few naphthenic acids are present in 400° F.—naphtha), atmospheric residua, and vacuum gas oils, e.g., 650–1050° F. Preferred feeds include whole and topped crudes and vacuum gas oils, particularly whole and topped crudes.

The feed may be treated at super-atmospheric, atmospheric, or sub-atmospheric pressure, e.g., 0.1 to 100 atmospheres, preferably less than 15 atmospheres, more preferably 1–10 atmospheres, and preferably in an inert atmosphere, e.g., nitrogen or other non-oxidizing gases. Because thermal treatment leads to acid decomposition, provisions for venting the gaseous decomposition products. i.e., $H_2O$ vapor $CO_2$, and CO, as well as the minimal cracking products, is appropriate. It is especially necessary to continuously sweep away water vapor produced in the acid decomposition or by evaporation of water indigenous with the feed to minimize inhibition of the acid decomposition process. Any light ends or light cracked hydrocarbon products can be recovered by condensation, and if desirable, recombined with the treated feed. In practice, soaking drums with venting facilities may be used to carry out the thermal treatment process. In a preferred embodiment, $CO_2$ and CO would also be swept away. This sweep gas may be natural gas, or other light hydrocarbon gases as may be generally available at refineries or production facilities. Purge rates of sweep gas would be in the range of 1–2000 standard cubic feet per barrel of feed (SCF/Bbl).

While treatments are time-temperature dependent, temperatures are preferably in the range of 600–900° F., more preferably 700–800° F. Treatment (residence time at temperature) times may vary widely and are inversely related to temperature, e.g., 30 seconds to about 10 hours, preferably 1–90 minutes, more preferably 30–90 minutes. Of course, at any given temperature longer treatment times will generally result in lower viscosity values, while taking care not to exceed the cracking levels previously mentioned.

As mentioned, soaking drums may be employed to carry out the process either on a batch or continuous basis. Engineers skilled in the art will readily envisage tubular reactions to effect the process.

The following examples further illustrate the invention and are not meant to be limiting in any way.

EXAMPLES

Example 1

Experiments conducted in an open reactor (all, except as otherwise noted) included distillation equipment similar to the described in ASTM D-2892 or ASTM D-5236. About 300 grams of a sample of 650° F.+ portion of crude was placed in a distillation flask. (Whole crude, while readily usable, was not used in order to prevent physical losses of the 650° F.—portion of the sample). The sample was rapidly heated to the desired temperature and held at that temperature for up to six hours under an inert atmosphere, e.g., nitrogen. Agitation was effected either by bubbling nitrogen through the sample, and preferably by stirring with a magnetic stirrer bar. Aliquots were withdrawn periodically for viscosity measurements.

In a series of experiments, thermally treated naphthenic acid decomposition was conducted as a function of temperature and of time. These were performed in an open reactor with nitrogen sweep gas to remove gaseous reaction products such as $C_1$–$C_4$ hydrocarbons, $H_2O$ vapor, $CO_2$, and CO. Viscosity in centistokes (CSt) at 104° F. by ASTM method D-445, and total acid number (TAN) in mg KOH/g of oil by ASTM method D-664 were measured and the results are shown in Table 1.

TABLE I

Tests with the 650° F. + Fraction of Bolobo 2-4 Crude

| | Temperature: | | | | | |
|---|---|---|---|---|---|---|
| | 725° F. | | 700° F. | | 675° F. | |
| Treat Time | % Vis Reduction | % TAN Reduction | % Vis Reduction | % TAN Reduction | % Vis Reduction | % TAN Reduction |
| 0.5 Hour | 56 | 54 | 23 | 9 | 4 | 3 |
| 1.0 Hour | 73 | 82 | 39 | 31 | 10 | 44 |
| 2.0 Houus | 92 | 84 | 70 | 54 | 32 | 49 |

Initial Viscosity at 104° F. = 4523 cSt
Initial TAN = 6.12 mg KOH/g oil

As seen from Table 1, viscosity reduction tracks TAN reduction and the percentages increase with increasing thermal treatment temperature and/or time.

Example 2

In another series of experiments thermally treated naphthenic acid decomposition was conducted in an autoclave on whole crude as functions of temperature and sweep gas rate. In experiments Test 1 and Test 2, produced gases were continuously swept away with helium at a rate of 1275 SCF/Bbl while in experiment Test 3, product gases were retained such that the maximum pressure rose to 100 psig. Viscosity at 104° F. and TAN were determined and results are shown in Table 2.

TABLE 2

Tests with Dewatered Kome + Bolobo Crude Blend as Feed (Initial Viscosity = 911 cSt at 104° F.)

| Test Number | Thermal Treat Temperature (° F.) | Maximum Pressure (psig) | Inert Gas Sweep Rate (SCF/Bbl) | Viscosity (cSt) at 104° F. | % TAN Reduction |
|---|---|---|---|---|---|
| 1 | 750 | 45 | 1275 | 277 | 86.3 |
| 2 | 725 | 45 | 1275 | 377 | 84.9 |
| 3 | 725 | 100 | 0 | 467 | 44.3 |

The results confirm that higher treat temperature results in lower viscosity and TAN for whole crude (experiments Test 1 vs. Test 2). The results also show that sweeping the gases from the reaction zone lower the reaction vessel pressure and result in lower viscosity and higher TAN reduction (experiments Test 2 vs. Test 3).

Example 3

The following series of experiments were performed to assess the impact of water vapor, $CO_2$, and CO on viscosity reduction by thermal treatment.

TABLE 3

Tests with Dewatered Kome + Bolobo Crude Blend as Feed (Initial Viscosity = 911 cSt at 104° F.)

| Test Number | 1 | 2 | 3 | 4 |
|---|---|---|---|---|
| $CO_2$ + CO, psia | 0.45 | 0.36 | 0.34 | 0.38 |
| $CO_2$ added, psia | — | — | 12.3 | — |
| CO added, psia | — | — | — | 12.1 |
| $H_2O$ added, psia | — | 27 | 16.6 | 16.4 |
| $H_2O$ added, g/min. | — | 0.13 | 0.08 | 0.08 |
| Viscosity (cSt) at 104° F. | 178 | 202 | 193 | 203 |
| % TAN Reduction | 87.6 | 76.3 | 72.7 | 78.7 |

In experiment Test 1, with no water vapor added and carbon oxides only resulting from naphthenic acid decomposition, the lowest viscosity was measured, corresponding to the highest TAN reduction of 87.6%. In Test 2, only water vapor was added to the sweep gas and this showed a higher viscosity and lower % TAN reduction. When $CO_2$ and CO partial pressure substituted for some of the water the effects of relatively higher viscosity and lower % TAN reduction were also observed as in Test 3 and Test 4, respectively, thereby showing the inhibition effect of water, enhanced by $CO_2$ or CO.

What is claimed is:

1. A process for reducing the viscosity of hydrocarbon feeds having TAN in excess of 2 mg KOH/gm which comprises (a) thermally treating the feed in a treatment zone at a temperature of at least about 400° F. for a period of time sufficient to substantially reduce the viscosity level of the hydrocarbon feed while (b) simultaneously removing gaseous reaction products from the treatment zone during said thermal treating step thereby reducing viscosity of said hydrocarbon feed.

2. The process of claim 1 wherein treatment temperature is at least about 600° F.

3. The process of claim 1 wherein treatment temperature ranges from about 600–900° F.

4. The process of claim 1 wherein the treatment time ranges from about 1 minute to about 10 hours.

5. The process of claim 1 wherein the feed is a whole crude.

6. The process of claim 1 wherein the feed is a topped crude.

7. The process of claim 1 wherein treating pressure is about 1–10 atmospheres.

8. The process of claim 1 wherein said process produces gaseous reaction products, CO, $CO_2$, and water vapor, which are simultaneously removed from the treatment zone during said thermal treating step.

9. The process of claim 1 wherein said process produces gaseous reaction products CO, $CO_2$, water vapor, and light hydrocarbons which are simultaneously removed from the treating zone during said thermal treating step.

* * * * *